United States Patent [19]

Kaufman et al.

[11] 3,954,419

[45] May 4, 1976

[54] FABRICATION OF NONSPARKING TITANIUM DIBORIDE MINING TOOLS

[75] Inventors: Lawrence P. Kaufman, Brookline; Richard L. Pober, Newtonville, both of Mass.

[73] Assignee: The United States of America as represented by the Secretary of the Interior, Washington, D.C.

[22] Filed: June 19, 1975

[21] Appl. No.: 588,548

[52] U.S. Cl. ..... 29/182.5; 75/202; 75/226

[51] Int. Cl.[2] ..... C22C 29/00; C22C 1/05

[58] Field of Search ..... 29/182.5; 75/202, 226

[56] References Cited

UNITED STATES PATENTS 2,996,793 8/1961 Jayne ..... 75/202 X

FOREIGN PATENTS OR APPLICATIONS 686,187 5/1964 Canada ..... 75/202

*Primary Examiner*—Benjamin R. Padgett
*Assistant Examiner*—R. E. Schafer
*Attorney, Agent, or Firm*—Gersten Sadowsky; Donald R. Fraser

[57] ABSTRACT

Titanium diboride is composited with about 11 to 13 per cent by weight of copper and about 2 to 4 per cent by weight of nickel, preferably by mixing the constituents in powdered form, heating the mixture to about 2000°F, and then hot pressing at a pressure of about 3000 psi and a temperature of about 2650°F. The titanium diboride-copper-nickel composite composition possesses execellent strength and non-sparking properties useful in the fabrication of mining tools and implements.

5 Claims, No Drawings

FABRICATION OF NONSPARKING TITANIUM DIBORIDE MINING TOOLS

FIELD OF THE INVENTION

This invention relates to refractory metal boride compositions, and more particularly to compositions of titanium diboride composited with copper and nickel which possess excellent strength and non-sparking properties.

DESCRIPTION OF THE PRIOR ART

The mining industry, and in particular the coal mining industry, has for many years sought to improve the safety of mining operations by developing methods for reducing the number and frequency of fires and explosions occuring during mining operations in a flammable environment. During coal mining operations, these fires and explosions, hereinafter referred to as ignitions, occur during cutting operations when the tool bits employed for cutting coal from its underground seams strike sandstone, sulfur balls, and/or other non-coal singularities in the flammable environment. These ignitions result from sparks generated during the impact of the tool bits on the singularities, or from hot spots generated in the tool in the area of impact.

To reduce the ignitions which occur during the impact of the tools on such singularities, tools are often fabricated from, or coated with, non-sparking materials. The most widely used non-sparking tool material presently employed is a tungsten carbide-cobalt composite material, containing about 94 per cent by weight tungsten carbide and about 6 per cent by weight cobalt. The material possesses excellent strength and non-sparking properties, but suffers from the disadvantage of developing ignition-causing hot spots at high impact and friction conditions.

Titanium diboride possesses excellent non-sparking properties and an excellent resistance to the development of hot spots. Its use as a tool material in the pure form, however, is limited because of the lack of physical strength thereof. Coatings of pure titanium diboride on conventional steel tools are not practical for extensive use, since the coatings wear, or chip away, exposing spark-generating steel subsurfaces. Thick titanium diboride coatings experience thermal expansion and coherency problems. As a solid tool material, titanium diboride suffers from a lack of strength, the bend strength of titanium diboride being about one fifth that of present tungsten carbide tool material, while the impact strength is about one third.

SUMMARY OF THE INVENTION

According to the invention, a composition is provided which comprises approximately 84 to 86 per cent by weight of titanium diboride composited with copper and nickel. Preferably, the percentage by weight of copper is about 11 to 13 percent and the percentage by weight of nickel is about 2 to 4 per cent. The composition is formed by compacting the constituents in powder form under pressure and heat, as by conventional powdered metallurgy techniques. Under a preferred embodiment, the composition is formed by mixing the constituents in powdered form, heating the mixture in a graphite die to about 2000°F, applying a pressure of about 3000 psi and then heating the mixture while under pressure to about 2650° until the powdered mixture is completely compacted. The composite material of the invention exhibits excellent strength properties, and shows no tendencies to generate sparks or hot spots when impacted against materials normally encountered in mining operations.

Other features and advantages of the invention will be set forth in, or apparent from, the detailed description of a preferred embodiment found hereinbelow.

DETAILED DESCRIPTION OF THE PREFERRED EMBODIMENTS

The titanium diboride-copper-nickel composite compositions of the invention are produced, in general, by compacting mixtures of the constituents in powdered form, and in the correct relative proportions, using pressure and heat. Such compacting techniques are well known in the powdered metal art. Thus, powdered titanium diboride, powdered metallic copper, and powdered metallic nickel are mixed together in the correct relative proportions, as in a dry ball mill in air. The mixture is then hot pressed, under high temperatures and pressures, for examples 2500°F and 3000 psi, in a heated hydraulic press. The mixture is pressed for a time sufficient to completely compact the mixture into a dense solid mass.

The copper and nickel are added to obtain the best combination of physical properties at the lowest possible processing temperature. While other metal additives could be used, it has been found that the use of copper and nickel in the correct relative proportions provides a resultant material having excellent strength properties and with no deleterious effects on the excellent non-sparking properties of pure titanium diboride.

The relative proportions of the copper and nickel added to the titanium diboride are critical, since variance in these properties can greatly affect the physical properties of the resultant material. Thus, a composite containing 95 per cent by weight titanium diboride, 1 per cent by weight copper and 4 per cent by weight nickel may exhibit excellent hardness and bend strength properties, but will have an impact strength of about two-thirds that of a composite containing 85 per cent by weight of titanium diboride, 12.5 per cent by weight of copper and 2.5 per cent by weight of nickel. Preferably, the composite composition should be about 84 to 86 per cent by weight titanium diboride with the remainder copper and nickel. In a specific preferred embodiment, the composition comprises about 13 to 11 per cent by weight copper, and about 4 to 2 per cent by weight nickel.

While satisfactory results may be obtained by forming the compositions of the invention by general techniques known in the powdered metal art, it has been found that the conditions employed in the method of manufacturing the materials of the invention will affect the physical properties of the material produced. Preferably, the material of the invention is formed by first heating the mixture of the powdered constituents in the correct relative proportions to about 1900° to 2100°F, then applying a pressure of about 2700 to 3300 psi, followed by heating the material to about 2600° to 2700°F while the pressure is being applied. It has been found that when the above conditions are used, as opposed to heating the mixture directly to about 2600° to 2700°F and then applying the pressure, that the material produced has an impact strength about 20 per cent greater, and a bend strength about 10 per cent greater.

In all cases, the composition according to the invention produces superior results to the tungsten carbide-cobalt composition presently used in mining tools when tested for incendivity properties. Thus, the material of the invention will not produce ignitions in a flammable atmosphere when impacted against materials normally encountered in mining operations, at conditions where the presently used tungsten carbide-cobalt tool material does produce such ignitions.

The following examples serve to illustrate the invention:

EXAMPLES 1–36

In the following examples, titanium diboride-copper-nickel composite materials of varying relative properties were produced by a common method. The method consisted of mixing the powder constituents in the desired proportions in air in a dry ball mill and then loading the mixture so produced into a graphite foil lined graphite die. The die was circular, being about three and one half inches in diameter, and sufficient mixture was put into the die to form a final solid wafer about one half inch thick. The die was then loaded into a 150 ton hydraulic press which had a 50kw, 3kH$_z$ motor generator induction heating unit for heating the die and piston assembly. A 100 psi holding pressure was applied and the die assembly was heated to 2000°F. When this preheat temperature was reached, the hydraulic pressure exerted on the powder components was increased to 3000 psi. The die was then further heated to a temperature of 2600°F while the pressure was maintained at 3000 psi, and held at these conditions until the material had reached its full density, usually in about 4 hours. The heating unit was then switched off and the assembly allowed to cool. The pressure was released when the die assembly had cooled to about 2550°F. Cooling of the assembly was slow due to the massive size of the die and insulation required to prevent attack of the graphite die by the ambient air. A reducing atmosphere was generated in the die during hot pressing since the carbon monoxide formed by reaction of the air and graphite is more stable then carbon dioxide.

The powder mixtures employed in the following examples all consisted of powdered titanium diboride, of about 1 to 10 (microns) in size, powdered metallic copper of about minus 325 mesh in size, and powdered metallic nickel of about minus 100 mesh in size. Table I lists the relative proportions of each constituent employed. The percentages are listed as a weight percent of the starting powder mixtures.

The materials produced, in disc form, were sectioned to obtain samples for testing. The materials were tested for hardness, with a Knoop indenter having a 100 gram load; fourpoint bend strength in triplicate on 0.100 × 0.200 × 2.165 inches overall-dimension samples on a support span of 1.56 inches and a load span of 0.78 inches impact strength in triplicate on 0.394 × 0.394 × 2.188 inches bars which contained a 0.020 inch wide by 0.080 inch deep saw kerf notch, with a pendulum energy of 1.0 ft. lb. at a velocity of 7.2 ft/sec. Results are listed in Table I below.

TABLE I

| Example | Composition - wt.% $TiB_2$ - Cu - Ni | Hardness Kg/mm² | Impact Strength in-lb/in² | Bend Strength (psi) |
|---|---|---|---|---|
| 1 | 95 - 0.8 - 4.2 | 3400 | 3.7 | 62,800 |
| 2 | 95 - 1.0 - 4.0 | 3500 | 3.5 | 66,500 |
| 3 | 95 - 1.3 - 3.7 | 3400 | 2.8 | 56,000 |
| 4 | 95 - 1.7 - 3.3 | 3350 | 3.6 | 68,200 |
| 5 | 95 - 2.5 - 2.5 | 3250 | 3.7 | 60,300 |
| 6 | 90 - 1.6 - 8.4 | 3550 | 3.7 | 41,900 |
| 7 | 90 - 1.6 - 8.4 | 3450 | 3.6 | 38,500 |
| 8 | 90 - 2.0 - 8.0 | 3450 | 3.4 | 49,400 |
| 9 | 90 - 2.0 - 8.0 | 3450 | 6.2 | 38,700 |
| 10 | 90 - 2.5 - 7.5 | 3400 | 3.5 | 56,000 |
| 11 | 90 - 2.5 - 7.5 | 3400 | 3.8 | 46,000 |
| 12 | 90 - 3.3 - 6.7 | 3150 | 3.8 | 52,400 |
| 13 | 90 - 3.3 - 6.7 | 3300 | 3.6 | 54,600 |
| 14 | 90 - 5.0 - 5.0 | 3450 | 3.4 | 53,600 |
| 15 | 90 - 5.0 - 5.0 | 3400 | 3.6 | 45,700 |
| 16 | 90 - 8.0 - 2.0 | 3050 | 3.4 | 46,600 |
| 17 | 85 - 2.5 - 12.5 | 3450 | 3.8 | 38,100 |
| 18 | 85 - 3.0 - 12.0 | 3250 | 3.2 | 40,000 |
| 19 | 85 - 3.7 - 11.3 | 3300 | 6.0 | 52,300 |
| 20 | 85 - 3.7 - 11.3 | 3300 | 3.8 | 45,000 |
| 21 | 85 - 3.7 - 11.3 | 3350 | 6.2 | 39,700 |
| 22 | 85 - 5.0 - 10.0 | 3350 | 3.6 | 44,900 |
| 23 | 85 - 7.5 - 7.5 | 3800 | 4.0 | 51,000 |
| 24 | 85 - 10.0 - 5.0 | 3150 | 3.7 | 64,400 |
| 25 | 85 - 11.3 - 3.7 | 3000 | 5.2 | 60,300 |
| 26 | 85 - 12.0 - 3.0 | 3150 | 5.8 | 55,000 |
| 27 | 85 - 12.5 - 2.5 | 3050 | 6.8 | 46,400 |
| 28 | 80 - 4.0 - 16.0 | 3400 | 3.2 | 55,800 |
| 29 | 80 - 5.0 - 15.0 | 3400 | 5.0 | 53,700 |
| 30 | 80 - 5.0 - 15.0 | 3400 | 3.5 | 53,200 |
| 31 | 80 - 5.0 - 15.0 | 3150 | 3.9 | 42,300 |
| 32 | 80 - 5.0 - 15.0 | 3250 | 3.6 | 49,700 |
| 33 | 80 - 6.7 - 13.3 | 3300 | 6.0 | 51,200 |
| 34 | 80 - 10.0 - 10.0 | 3450 | 3.9 | 50,400 |
| 35 | 75 - 6.3 - 18.7 | 3350 | 3.4 | 54,200 |
| 36 | 70 - 7.5 - 22.5 | 3350 | 4.4 | 58,300 |

Incendivity tests were run on selected samples of the materials having dimensions ⅜ × ⅜ × 1⅛ inch, by impacting the material against quartzite sandsone in a flammable 7% natural gas-air atmosphere. The samples were attached to a massive rotating wheel with a peripheral speed range of 120–1320 ft/min. A rock specimen, secured to a steel table was advanced into the cutter wheel at a fixed rate, of 0 to 2 in./min. The impact energy was determined by accurately measuring the angular velocity of the wheel, and using this figure, together with the known moment of inertia of the wheel, to determine the kinetic energy. The wheel was powered during one half of each revolution and allowed to free-wheel during the other half. Time measurements in determining the angular velocity were made during the free-wheeling half cycle. The results of the extensive testing are listed in Table II. In addition, incendivity tests were run on tungsten carbide-cobalt composite materials corresponding to those in present use, and the results are included for comparison.

TABLE II

RESULTS OF INCENDIVITY TESTS AT U.S. BUREAU OF MINES, ALBANY, OREGON

| Example | Material (weight percent) ($TiB_2$-Cu-Ni) | Tool Speed Feed/Impact (fpm/mil) | No. of Impacts | Maximum Energy (ft-lbs) | Ignition | Weight Loss (mg) | Flank Wear Land (mil) | Chipping |
|---|---|---|---|---|---|---|---|---|
| 1 | 95-0.8-4.2 | 450/0.8 | 319 | 70 | No | 44.4 | 12.5 | Slight |
| | | 450/12.0 | 34 | 73 | No | 2.9 | 1.6 | None |
| | | 900/0.8 | 310 | 91 | No | — | — | Severe |
| | | 900/12.0 | 32 | 115 | No | — | 3.1 | Moderate |
| 2 | 95-1.0-4.0 | 450/0.8 | 303 | 146 | No | 137.0 | — | Moderate |

TABLE II-continued

RESULTS OF INCENDIVITY TESTS AT U.S. BUREAU OF MINES, ALBANY, OREGON

| Example | Material (weight percent) ($TiB_2$-Cu-Ni) | Tool Speed Feed/Impact (fpm/mil) | No. of Impacts | Maximum Energy (ft-lbs) | Ignition | Weight Loss (mg) | Flank Wear Land (mil) | Chipping |
|---|---|---|---|---|---|---|---|---|
| | | 450/12.0 | 32 | 131 | No | — | — | Severe |
| | | 900/0.8 | 307 | 49 | No | — | — | Severe |
| 19 | 85-3.7-11.3 | 450/0.8 | 231 | 106 | No | 40.0 | 9.4 | Slight |
| | | 450/12.0 | 33 | 161 | No | — | — | Severe |
| | | 900/0.8 | 316 | 66 | No | 73.1 | 6.2 | None |
| | | 900/12.0 | 34 | 184 | No | — | 9.4 | Moderate |
| 26 | 85-12-3.0 | 450/0.8 | 306 | 138 | No | 36.6 | 15.6 | Moderate |
| | | 450/12.0 | 33 | 133 | No | 41.4 | 14.1 | Slight |
| | | 900/0.8 | 309 | 92 | No | 32.0 | 12.5 | None |
| | | 900/12.0 | 34 | 92 | No | 10.2 | 6.2 | None |
| | | 900/18.0 | 11 | 146 | Yes* | 6.1 | 12.5 | None |
| 27 | 85-12.5-2.5 | 450/0.8 | 303 | 130 | No | 75.2 | 17.2 | None |
| | | 450/12.0 | 16 | 250 | No | 95.0 | 15.6 | Slight |
| 29 | 80-5.0-15.0 | 450/0.8 | 309 | 132 | No | — | 7.8 | Moderate |
| | | 450/12.0 | 30 | 169 | No | — | — | Severe |
| 33 | 80-6.7-13.3 | 450/0.8 | 303 | 147 | No | 44.4 | 12.5 | Slight |
| | | 900/0.8 | 309 | 50 | No | 10.5 | 14.1 | Slight |
| | | 900/12.0 | 33 | 178 | No | — | — | Severe |
| 36 | 70-7.5-22.5 | 450/0.8 | 310 | 118 | No | 14.9 | 6.3 | Moderate |
| | | 450/12.0 | 32 | 128 | No | 16.8 | 33.1 | None |
| | | 900/0.8 | 315 | 87 | No | 10.4 | 10.9 | Slight |
| | | 900/12.0 | 35 | 153 | No | 29.1 | 3.1 | None |
| Tungsten Carbide-Cobalt wt % | | | | | | | | |
| 90–10 $(WC)_{0.90}$ $Co_{0.10}$ | | 450/0.8 | 313 | 118 | No | 91 | — | None |
| | | 450/12 | 38 | 108 | No | 29 | — | None |
| (90 wt. % WC- | | 900/0.8 | wt. | 74 | Yes | 55 | — | None |
| 10 wt. % Co) | | 900/12 | 14 | 75 | Yes | 23 | — | None |
| 90–10 $(WC)_{0.90}$ $Co_{0.10}$ | | 900/0.8 | 42 | 67 | Yes | — | — | — |
| | | 605/1.5 | 78 | 119 | Yes | — | — | — |
| | | 1100/3.0 | 19 | 71 | Yes | — | — | — |
| | | 625/3.0 | 39 | 180 | Yes | — | — | — |
| | | 900/6.0 | 6 | 57 | Yes | — | — | — |
| | | 900/1.5 | 116 | 119 | No | — | — | — |
| 87–13 $(WC)_{0.87}$ $Co_{0.13}$ | | 450/0.8 | 315 | 68 | No | 29 | — | None |
| | | 450/12 | 30 | 108 | No | 18 | — | None |
| | | 900/0.8 | 377 | 49 | No | 19 | — | None |
| | | 900/12 | 20 | 155 | Yes | 31 | — | None |

*Ignition due to melted sandstone deposited on tool which resulted in sandstone-on-sandstone impacts.

EXAMPLES 37 – 46

In the following examples the procedures of examples 1–36 were followed, except that the hot press cycle consisted of heating to 2000°F, applying a pressure load of 3000 psi, and then heating to only 2400°F. The compositions formed were tested for hardness, impact strength, and bend strength, as in Examples 1–36. Results are given in Table III. In general, materials were produced which had inferior physical strength properties as compared with those of Examples 1–36.

TABLE III

| Example | Composition - wt.% $TiB_2$ - Cn - Ni | Hardness | Impact Strength in-lb/in² | Bend Strength psi |
|---|---|---|---|---|
| 37 | 85--2.5-12.5 | 3300 | 3.5 | 47,900 |
| 38 | 85--3.0-12.0 | 3300 | 3.5 | 50,100 |
| 39 | 85--3.7-11.3 | 3350 | 3.5 | 48,300 |
| 40 | 85--5.0-10.0 | 3300 | 3.7 | 54,300 |
| 41 | 85--7.5--7.5 | 3200 | 3.0 | 46,900 |
| 42 | 85--7.5--7.5 | 3500 | 3.9 | 48,800 |
| 43 | 85-10.0--5.0 | 3350 | 3.7 | 49,600 |
| 44 | 85-11.3--3.7 | 3400 | 3.4 | 45,200 |
| 45 | 85-12.0--3.0 | 3300 | 4.4 | 35,900 |
| 46 | 85-12.5--2.5 | 3200 | 4.1 | 30,600 |

EXAMPLES 47 – 51

In the following examples the procedures of Examples 1–36 were followed, except that the hot press cycle consisted of heating the mixture directly to 2650°F and then applying the 3000 psi load. The composites formed were tested for hardness, impact strength, and bend strength, as in Examples 1–36. Results are given in Table IV. In general, materials were produced having a greater hardness, but lower impact and bend strengths as compared with those of Examples 1–36.

TABLE IV

| Example | Composition -wt% $TiB_2$ - Cn - Ni | (kg/mm²) Hardness | Input Strength in-lb/in² | Bend Strength psi |
|---|---|---|---|---|
| 47 | 85--2.5-12.5 | 3900 | 3.5 | 43,200 |
| 48 | 85--3.0-12.0 | 3700 | 5.0 | 40,000 |
| 49 | 85--3.7-11.3 | 3800 | 3.9 | 41,300 |
| 50 | 85--5.0-10.0 | 3900 | 4.0 | 37,800 |
| 51 | 85--7.5--7.5 | 3600 | 4.6 | 44,200 |

Although the invention has been described with respect to exemplary embodiments thereof, it will be understood that variations and modifications can be effected in the embodiments without departing from the scope or spirit of the invention.

We claim:

1. A composite metallurgical composition comprising approximately 84 to 86 per cent by weight of titanium diboride, and approximately 16 to 14 per cent by weight of copper and of nickel.

2. The composition as claimed in claim 1 wherein the copper comprises approximately 13 to 11 per cent by weight of the composition.

3. The composition as claimed in claim 1 wherein the nickel comprises approximately 4 to 2 per cent by weight of the composition.

4. The method of producing a composite metallurgical composition comprising forming a mixture consisting of approximately 84 to 86 per cent by weight of powdered titanium diboride and approximately 16 to 14 per cent by weight of powdered copper and powdered nickel, heating said mixture to about 1900° to 2100°F, applying a hydraulic pressure of approximately 2700 to 3000 psi to said mixture, and then heating said mixture to approximately 2600° to 2700°F while applying said hydraulic pressure.

5. The method as claimed in claim 4 wherein said mixture consists of approximately 84 to 86 per cent by weight of powdered titanium diboride, approximately 13 to 11 per cent by weight of powdered copper, and approximately 4 to 2 per cent by weight of powdered nickel.

* * * * *